United States Patent [19]

Löffler et al.

[11] Patent Number: 4,833,749

[45] Date of Patent: May 30, 1989

[54] HEEL SUPPORT DEVICE FOR SUPPORTING A LAST WITHOUT MOVEMENT THEREOF

[75] Inventors: Tilo Löffler, Pirmasens; Willi Hartmann, Lemberg, both of Fed. Rep. of Germany

[73] Assignee: Schön & Cie. GmbH, Pirmasens, Fed. Rep. of Germany

[21] Appl. No.: 115,033

[22] Filed: Oct. 30, 1987

[30] Foreign Application Priority Data

Nov. 3, 1986 [DE] Fed. Rep. of Germany ..... 3637297

[51] Int. Cl.[4] ..... A43D 21/16; A43D 21/00

[52] U.S. Cl. ..... 12/12.4; 12/12

[58] Field of Search ..... 12/12.4, 12, 12.2, 8.8, 12/10.5, 14.3, 14.4

[56] References Cited

U.S. PATENT DOCUMENTS

| | | | |
|---|---|---|---|
| 2,039,448 | 5/1936 | Pym | 12/14.5 |
| 2,774,086 | 12/1956 | Burby | 12/12.4 |
| 3,091,786 | 6/1963 | Vornberger | 12/12.4 |
| 3,683,439 | 8/1972 | Muhlbach et al. | 12/14.4 |
| 4,319,373 | 3/1982 | Lavckhardt et al. | 12/10.5 |
| 4,470,165 | 9/1984 | Becka | 12/14.4 |
| 4,530,124 | 7/1985 | Sommer | 12/12 |
| 4,627,124 | 12/1986 | Winter | 12/123 |
| 4,653,133 | 3/1987 | Giebel | 12/10.5 |
| 4,688,288 | 8/1987 | Giebel | 12/12.2 |

*Primary Examiner*—Steven N. Meyers

*Attorney, Agent, or Firm*—Wenderoth, Lind & Ponack

[57] ABSTRACT

A heel support device for use in a shoe making machine for forming the toe and sides of a shoe upper tensioned over a last seated on a last support include a guide fixed with respect to the machine. A heel support member is mounted for movement guided by the guide by a drive to a supporting position whereat the heel support member bears against and supports a heel portion of the last or heel portion of the upper tensioned therearound. A switch is operatively connected to the drive and is actuated by the heel support member reaching the supporting position to stop operation of the drive upon movement of the heel support member to the supporting position. As a result, the heel support member cannot move the last from a predetermined position.

22 Claims, 3 Drawing Sheets

HEEL SUPPORT DEVICE FOR SUPPORTING A LAST WITHOUT MOVEMENT THEREOF

BACKGROUND OF THE INVENTION

The present invention relates to a heel support device for use in a shoe making or lasting machine for forming or lasting the toe and sides of a shoe upper that is tensioned over a last seated or resting on a last support. In this type of device, a heel support member is movable along a machine fixed guide by means of, for example, a hydraulically or pneumatically actuated drive, for example a piston/cylinder unit, toward the heel portion of the last until it rests directly thereagainst, or against a heel portion of the upper tensioned about the last. The heel support member serves as an abutment of the last against pressure acting on the last from the front thereof during a wiping or edging operation of forming the shoe. That is, the heel support member locks the position of the last with regard to the wiping or edging and pulling-over tools. Since the heel support device is moved against the last along a guide by means of a hydraulic or pneumatic piston/cylinder unit, the heel support member reaches its final position by simple abutment against the heel portion of the last, or of the upper tensioned therearound, and after this final position is reached, the heel support member remains under pressure acting in such direction of movement. The hydraulic or pneumatic pressure as the heel support member contacts with the last must be adjusted with great precision in order to prevent the last from being displaced, since if the last is displaced with respect to the wiping or edging and pulling-over tools, the toe and side forming operations cannot be performed properly.

SUMMARY OF THE INVENTION

With the above discussion in mind, it is an object of the present invention to provide an improved heel support device of the above general type, but whereby it is possible to avoid the above and other prior art disadvantages.

It is a more specific object of the present invention to provide such a heel support device which is operable to provide the necessary support or abutment of the last from pressures operating from the front thereof while at the same time avoiding any displacement of the last upon the movement of the heel support member to its supporting position and thereafter.

It is a still further object of the present invention to provide such an improved heel support device which is adaptable to existing equipment by the use of relatively simple structure.

These objects are achieved in accordance with the present invention by the provision of a heel support device for use in a shoe making machine for forming the toe and sides of a shoe upper tensioned over a last seated on a last support, the heel support device including a guide fixed with respect to the machine, a heel support member mounted for movement guided by the guide toward and away from the last, drive means for moving the heel support member along the guide in a direction toward the last to a supporting position whereat the heel support member bears against and supports a heel portion of the last or heel portion of the upper tensioned therearound, the improvement of means for preventing the heel support member from displacing the last upon movement to the supporting position. In particular accordance with the present invention, the last displacement preventing means comprises switch means, operatively connected to the drive means and actuated by the heel support member reaching the supporting position, for stopping operation of the drive means upon movement of the heel support member to the supporting position, and thereby for preventing further movement of the heel support member in such direction toward the last. Thus, in accordance with the present invention, upon the heel support member contacting the last or the upper tensioned thereabout, the switch means is operated to thereby immediately stop operation of the drive which moves the heel support member toward the last. As a result, the last is reliably supported with relatively simply devices without causing it to be displaced during the collision or contact of the heel support member against the heel portion of the last or the upper.

In accordance with an additional feature of the present invention, there may further be provided clamping means, operatively connected to the switch means, for, upon the heel support member reaching the supporting position, laterally clamping against side portions of the last or of the upper tensioned therearound. By providing this arrangement, the last is also laterally supported with regard to the operation of the wiping or edging and pulling-over operations, thus ensuring further reliable operation of the shoe lasting or making machine. Moreover, the lateral clamping of the last furthermore ensures that the last is in its proper position in the shoe lasting or making machine. The clamping means can be operated by the switch means simultaneously with the stopping of the drive means, or shortly thereafter.

In accordance with a further advantageous feature of the present invention, it is possible to provide locking means, operatively connected to the switch means, for, upon the heel support member reaching the supporting position, locking the position of a bearing member which supports the heel support member and preventing movement of the bearing member along the guide in a direction toward the last or in a direction away from the last. This feature of the present invention ensures that shearing forces acting on the last during the wiping or edging and pulling-over operations will be reliably absorbed. The locking means may be operated by the switch means simultaneously with the stopping of the drive means or shortly thereafter.

In one modification of the invention which is particularly advantageous from the constructional point of view, the heel support member comes directly into contact with the last or the upper tensioned thereabout, and the heel support member is mounted on a base plate for movement toward and away therefrom, with springs urging the heel support member away from the base plate. To prevent the heel support member from tipping in relation to the base plate, the heel support member may be guided on bolts or rods fastened to the base plate and mounting the heel support member thereon.

Particularly, the heel support device of the present invention will be operated reliably if the switch means is operated directly or indirectly by movement of the heel support member relative to the base plate upon contact of the heel support member with the last or the upper. In such case, the switch means can be operated by the heel support member or by the last itself, or the upper tensioned therearound. Thus, there is provided means for actuating the switch means upon movement of the heel support member toward the base plate resulting from the heel support member abutting the heel portion of the last or of the upper. Such actuating means may include the heel support member or an actuating member movable relative to the base plate. Such actuating member can abut the heel support member and be movable thereby relative to the base plate upon movement of the heel support member toward the base plate. The actuating member alternatively can abut the heel portion of the last or of the upper. The actuating member may be in the form of a pin or a rod slidably mounted relative to the base plate between switch actuating and nonactuating positions, with a spring urging the pin or rod toward the nonactuating position. Upon the heel support member contacting the last or the upper, the heel support member is moved toward the base plate, thereby moving the pin or the rod relative to the base plate and to the switch actuating position. The masses to be moved by the last for the operation of the switch means are therefore very small so that the last is prevented from moving from its predetermined position with regard to the wiping or edging and pulling-over positions. Preferably, the actuating means actuates the switch means upon the heel support member moving toward the base plate by an amount to just contact the base plate. In such arrangement, the heel support member is braced against the base plate in the clamping position of the last.

The switch means may be in the form of a non-contact switch, such as a proximity switch, a photoelectric switch, etc. It also is possible however to employ electromechanical, hydraulic or pneumatic switches, or other similar devices as would be well understood by one skilled in the art.

The clamping means for laterally clamping the last may be in the form of a pair of levers having respective clamping ends, means for pivotally mounting the levers for movement between a clamping position, whereat the clamping ends are moved toward each other against the sides of the last or the upper tensioned therearound, and an unclamping position, whereat the clamping ends are moved away from each other, means for pivoting the levers to the clamping position, and means for moving the levers to the unclamping position. At least the clamping position moving means is operated by the switch means. In the unclamping position, the clamping ends of the levers must be spaced a distance such that they will not interfere with the operation of the last. The clamping position moving means and the unclamping position moving means may be, for example, springs and/or pistons, for example fluid-operated pistons, such that the clamping and unclamping functions can be combined in a common structure. In a preferred arrangement the clamping position moving means comprise fluid-operated pistons and the unclamping position moving means comprise springs. To prevent the shoe upper from being damaged and to provide for the uniform application of pressure of the clamping ends against the sides of the last or the upper over a large area, the clamping ends of the levers may be provided with elastic clamps.

In a preferred arrangement of the locking means there is provided a lock member mounted on the bearing member which supports the heel support member. The lock member is movable from the bearing member into engagement with the guide to lock the position of the bearing member and therefore of the heel support member. The lock member may have a toothed end movable into meshing engagement with complementary teeth on the guide, or alternatively the lock member may have an end movable into friction engagement with the guide. In a particularly advantageous arrangement, the lock member may comprise a fluid-operated piston having an outer end which is capable of locking against the guide in either a toothed manner or a friction-locking manner.

In accordance with a further feature of the present invention, there is provided means for selectively pivoting the heel support member about a horizontal axis extending orthogonal to the direction of movement of the heel support member toward the last. For example, the heel support member may be pivotable about such axis relative to the bearing member. By this arrangement, the heel support member can be adapted to the shape of the heel portion of the particular last employed.

BRIEF DESCRIPTION OF THE DRAWINGS

Other objects, features and advantages of the present invention will be apparent from the following detailed description of preferred features thereof, with reference to the accompanying drawings, wherein.

DETAILED DESCRIPTION OF THE INVENTION

Figures 1, 3:
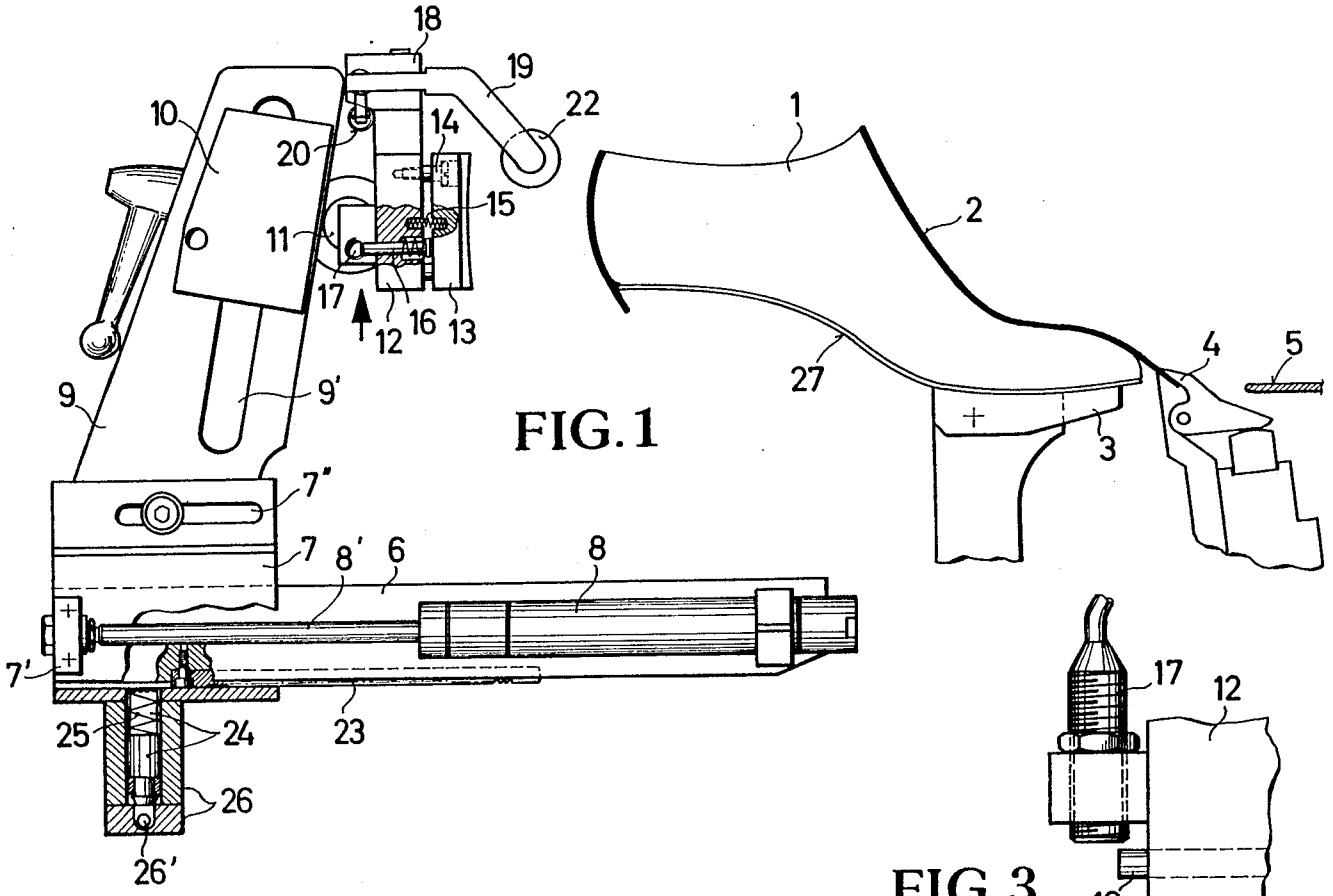
FIG. 1 is a side elevation view, partially in section, of a heel support device according to the present invention and shown prior to movement to a supporting position.
FIG. 3 is an enlarged detail view of a portion of the heel support device, viewed in the direction the of arrow A in FIG. 1.

In the drawings, there is shown a portion of a shoe lasting or making machine wherein a shoe last 1 and a shoe upper 2 are seated on a last support 3 of a toe lasting machine, not shown. Toe and lateral pincers 4 and shears 5 are shown partially and schematically in FIGS. 1 and 2. During wiping or edging and pulling-over operations it is necessary that the heel of last 1 be supported against the pressure exerted on the last by pincers 4 and shears 5.

This is achieved by a heel support device including a guide 6, for example in the form of a rod or a bar, fastened with respect to the frame of the machine. A bearing member 7 slides along guide 6 in directions toward and away from the last, and this movement is achieved by a drive which may be in the form of a fluid operated piston/cylinder unit 8 having a piston rod 8' fastened via a rim or projection 7' to bearing member 7. Mounted on bearing member 7 and extending upwardly therefrom is a support 9, for example bolted to bearing member 7 through a slot 71" therein. Support 9 moves back and forth with bearing member 7 and is angularly adjustable relative thereto. An attachment fitting 10 is mounted on support 9 in a manner to be vertically adjustable therealong, for example via slot 9' in support 9. A base plate 12 is connected to attachment fitting 10 via a transverse horizontal shaft 11 forming a bearing and enabling base plate 12 to adjustably swivel about the axis of shaft 11 relative to fitting 10. This enables base plate 12 to be rotated relative to fitting 10 to a suitable adjustment position with regard to the heel portion of last 1. A heel support member 13 is mounted on bolts or rods 14 which are fastened to base plate 12, such that heel support member 13 is guided by bolts 14 and is movable toward and away from base plate 12. Springs 15 urge heel support member 13 in a direction away from base plate 12. An actuating member 16 in the form of a pin or a rod is slidably mounted to extend through base plate 12 and to abut with heel support member 13. Actuating member 16 is spring biased in a direction toward heel support member 13.

A switch 17 is mounted on base plate 12 in a position to be actuated by actuating member 16.

Figure 2:
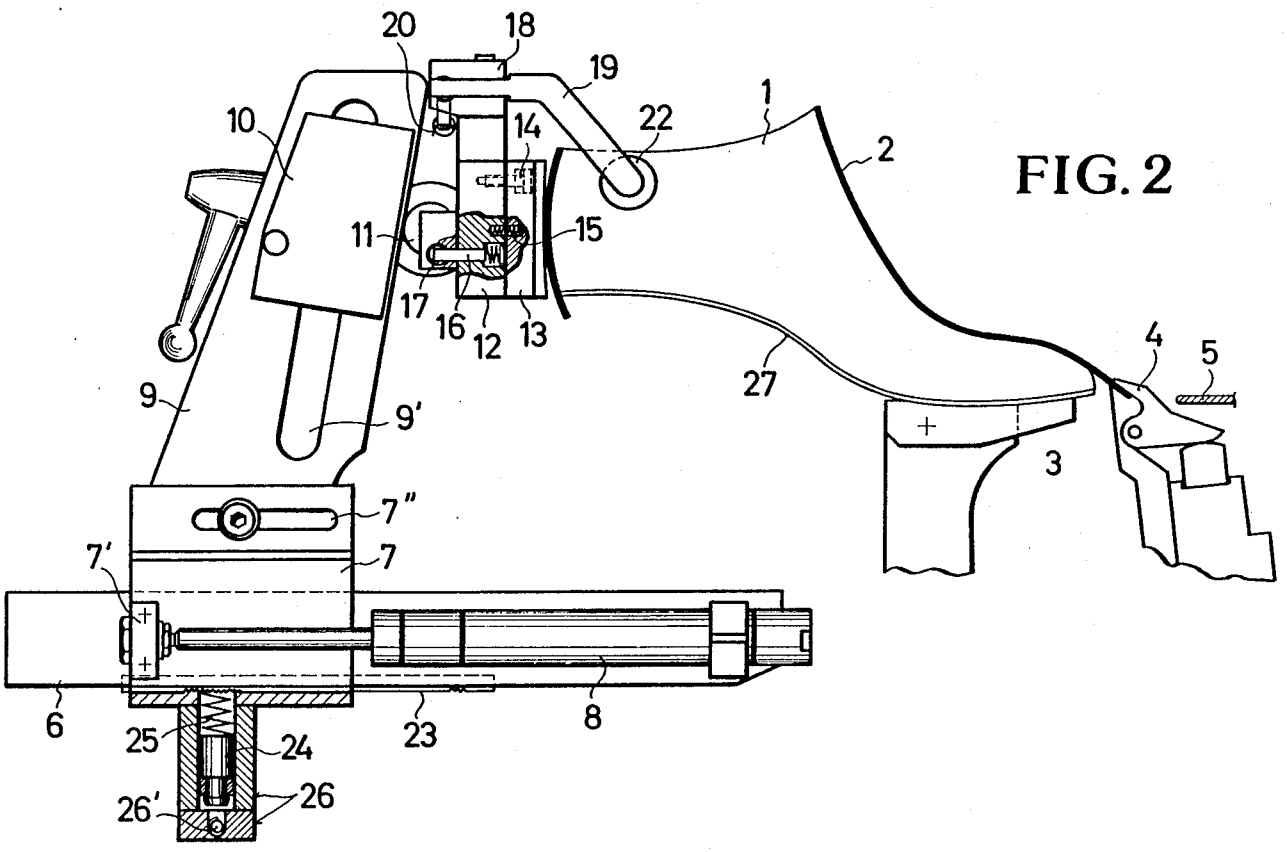
FIG. 2 is a view similar to FIG. 1 but showing the heel support device in a supporting position thereof.

The above heel support device operates in the following manner. Last 1 is inserted into the machine, and a start signal causes fluid to pressurize piston/cylinder unit 8 from the position shown in FIG. 1 to cause piston rod 8' to move bearing member 7 along guide 6 toward the position shown in FIG. 2. Movement of bearing member 7 simultaneously moves support 9, fitting 10, base plate 12 and heel support member 13. Upon heel support member 13 contacting last 1 or upper 2 tensioned therearound, movement of heel support member 13 is stopped, as is movement of actuating member 16. Base plate 12 and switch 17 continue to move until switch 17 is actuated by actuating member 16. In the preferred arrangement illustrated this occurs when base plate 12 just contacts heel support member 13, as shown in FIG. 2. Actuation of switch 17 immediately stops operation of the drive means, i.e. piston/cylinder unit 8. The manner of operative connection between switch 17 and piston/cylinder unit 8 is not specifically illustrated and is intended to be conventional as would be well understood by one skilled in the art. Springs 15 between heel support member 13 and base plate 12 are adjusted such that, upon contact with last 1 or the upper tensioned therearound, the latter will not be displaced. Preferably, the stopping of the travelling motion is so accurate that at such moment heel support member 13 and base plate 12 just touch each other. This ensures that the last will not be displaced relative to the other elements of the shoe making or lasting machine.

In accordance with an additional feature of the present invention there is provided clamping means, also operatively connected to switch 17, for laterally clamping against side portions of the last 1 or of the upper upon heel support member 13 reaching the supporting position shown in FIG. 2. Thus, a pair of clamping levers 19 are pivotally mounted about a fitting 18 mounted on base plate 12. Levers 19 have respective clamping ends, preferably provided with elastic clamps 22. Levers 19 are pivotally mounted on fitting 18 between a clamping position, shown in FIG. 4, whereat clamps 22 are moved toward each other and against the sides of the last or the upper 2 therearound, and an unclamping position whereat clamps 22 are moved away from each other and from the upper and last. Structure, for example springs 20 and/or pistons 21 are provided to move the levers 19 between the clamping and unclamping positions thereof. For example, in the arrangement illustrated pistons 21 move the levers to the clamping position shown in FIG. 4, and when the actuating force is removed from pistons 21, tension springs 20 return the levers to the unclamping position thereof. It would be understood by one skilled in the art however that other lever pivoting structures and arrangements could be employed.

Figure 4:
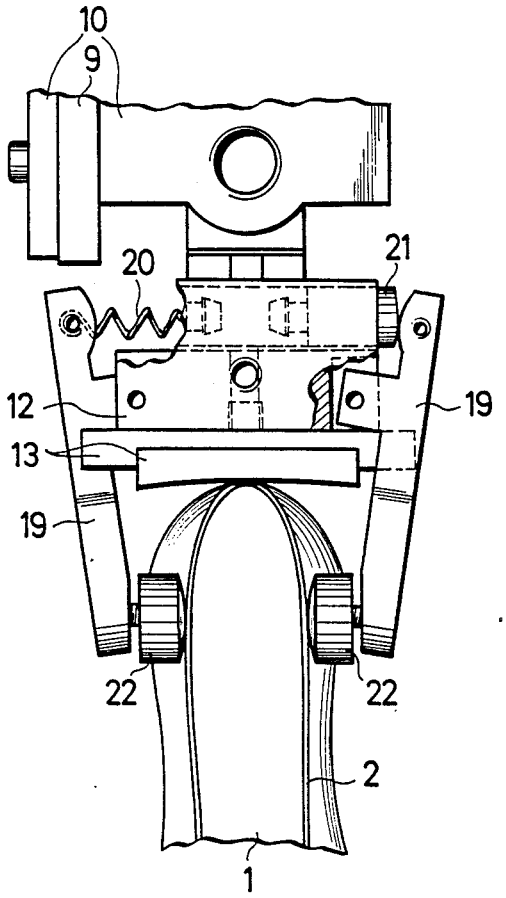
FIG. 4 is a plan view of a portion of the heel support device, taken generally from above with regard to FIG. 2.

The operation of the application of actuating pressure to pistons 21, in the illustrated arrangement, is controlled by the actuation of switch 17 such that, simultaneously with the stopping of piston/cylinder unit 8, or shortly thereafter, pistons 21 operate to pivot levers 19 to the clamping position shown in FIG. 4. The operative connection between switch 17 and pistons 21 is not specifically illustrated but is intended to be conventional and would be readily understood by one skilled in the art.

In accordance with a further feature of the present invention there is provided locking means, operatively connected to switch 17, for, upon heel support member 13 reaching the supporting position shown in FIG. 2, locking the position of bearing member 7 with regard to guide 6 and preventing movement of bearing member 7 along guide 6 in a direction either toward the last or away from the last. In the particular arrangement shown in the drawings, the locking means is in the form of a lock member comprising a fluid-operated piston 24 mounted within a cylinder 26 which is mounted on bearing member 7. A spring 25 urges piston 24 away from bearing member 7. A fluid inlet 26' introduces pressure into cylinder 26 to move piston 24 against the force of spring 25 in a direction outwardly of cylinder 26. The outer end of piston 24 is toothed to mesh with complementary teeth provided on a strip 23 mounted on, for example, the underside of guide 6. Thus, upon heel support member 13 reaching the supporting position shown in FIG. 2, resulting in actuation of switch 17, then switch 17 operates the locking device to introduce fluid through inlet 26' to cause locking of the piston of bearing member 7 with respect to guide 6. This operation may be achieved simultaneously with or shortly after the operation of switch 17 stopping operation of piston/cylinder unit 8. The operative connection between switch 17 and the locking means is not specifically illustrated but is intended to be conventional as would be readily understood by one skilled in the art. Although the illustrated arrangement shows illustrates a toothed locking, it also would be possible to provide a friction locking whereby the outer end of piston 24 would be moved into friction contact with a complementary surface of guide 6. Such manner of locking readily would be understood by one skilled in the art.

Thus, in accordance with the present invention, by a simple electrical control a switching pulse triggered by the operation of switch 17 causes, for example, the supply of a pressurized fluid to piston/cylinder unit 8 to be stopped. At the same time, or shortly thereafter, piston 24 is pressurized with fluid and produces a locking of bearing member 7 relative to guide 6. Also at the same time, or shortly thereafter, cylinder chambers of pistons 21 are pressurized with fluid to cause levers 19 to clamp against the lateral sides of last 1 and upper 2. As indicated above, the specific operative connections between switch 17 and units 8, 24, 21 are not specifically shown for facility of illustration. However, such specific operative connections readily would be understood by one skilled in the art and are intended to include only conventional electrical, hydraulic and/or pneumatic connections such as commonly employed.

Although the present invention has been described and illustrated with respect to a particularly preferred embodiment thereof, it is to be understood that various modifications and changes may be made to the specifically described and illustrated arrangement without departing from the scope of the present invention.

Particularly, instead of the particular actuating arrangement illustrated, it is possible to mount switch 17 on base plate 12 so that heel support member 13 itself actuates switch 17. It also is possible to provide an arrangement whereby the actuating member 16 extends from an end face of member 13 to operate switch 17. Also, the actuating member may be operated by direct contact with the last or the upper. Still further, the bearing member 7 can be moved by a torque motor or by a worm gear and pinion, etc., rather than by the piston/cylinder unit 8 as illustrated. It is to be understood that the present heel support device is operable in other conventional shoe making machinery and that the last may have mounted thereon insole 27. Furthermore, the spatial arrangement and layout of the heel support member 13 as well as of members 7, 9, 10, 11, 12 supporting heel support member 13 can be modified in a number of different ways without departing from the scope and spirit of the present invention.

We claim:

1. In a heel support device for use in a shoe making machine for forming the toe and sides of a shoe upper tensioned over a last seated on a last support, said heel support device including a guide fixed with respect to the machine, a base plate, a heel support member mounted on said base plate for movement toward and away therefrom, said base plate and said heel support member being mounted for movement guided by said guide toward and away from the last, drive means for moving said base plate and said heel support member along aid guide in a direction toward the last to a supporting position whereat said heel support member bears against and supports a heel portion of the last or a heel portion of the upper tensioned therearound, the improvement of means for preventing said heel support member from displacing the last upon movement to said supporting position, said last displacement preventing means comprising:

switch means, operatively connected to said drive means and actuated by said heel support member reaching said supporting position, for stopping operation of said drive means upon movement of said heel support member to said supporting position, and thereby for preventing further movement of said heel support member in said direction; and means for actuating said switch means to stop operation of said drive means as soon as said heel support member abuts the heel portion of the last or the upper.

2. The improvement claimed in claim 1, further comprising spring means urging said heel support member away from said base plate.

3. The improvement claimed in claim 2, further comprising rods mounting said heel support member on said base plate and guiding movement of said heel support member relative to said base plate.

4. The improvement claimed in claim 1, wherein said actuating means actuates said switch means upon movement of said heel support member toward said base plate resulting from said heel support member abutting the heel portion of the last or of the upper.

5. The improvement claimed in claim 4, wherein said actuating means comprises said heel support member.

6. The improvement claimed in claim 4, wherein said actuating means comprises an actuating member movable relative to said base plate.

7. The improvement claimed in claim 6, wherein said actuating member abuts said heel support member and is movable thereby relative to said base plate upon movement of said heel support member toward said base plate.

8. The improvement claimed in claim 6, wherein said actuating member abuts the heel portion of the last or of the upper.

9. The improvement claimed in claim 6, wherein said actuating member comprises a pin slidably mounted relative to said base plate between switch actuating and nonactuating positions, and spring means urging said pin toward said nonactuating position.

10. The improvement claimed in claim 4, wherein said actuating means actuates said switch means upon said heel support member moving toward said base plate by an amount to just contact said base plate.

11. The improvement claimed in claim 1, wherein said switch means comprises a non-contact switch.

12. The improvement claimed in claim 1, further comprising clamping means, operatively connected to said switch means, for, upon said heel support member reaching said supporting position, laterally clamping against side portions of the last or of the upper.

13. The improvement claimed in claim 13, wherein said clamping means comprises a pair of levers having respective clamping ends, means for pivotally mounting said levers for movement between a clamping position, whereat said ends are moved toward each other, and an unclamping position, whereat said ends are moved away from each other, means for pivoting said levers to said clamping position, and means for moving said levers to said unclamping position, at least said clamping position moving means being operated by said switch means.

14. The improvement claimed in claim 13, wherein said clamping position moving means comprise fluid operated pistons.

15. The improvement claimed in claim 13, wherein said unclamping position moving means comprise springs.

16. The improvement claimed in claim 13, wherein said lever ends have elastic clamps.

17. The improvement claimed in claim 1, further comprising a bearing member supporting said heel support member and mounted for movement by said drive means along said guide in directions toward and away from the last, and locking means, operatively connected to said switch means, for, upon said heel support member reaching said supporting position, locking the position of said bearing member and preventing movement thereof along said guide in either of said directions.

18. The improvement claimed in claim 17, wherein said locking means comprises a lock member mounted on said bearing member and movable therefrom into engagement with said guide.

19. The improvement claimed in claim 18, wherein said lock member has a toothed end movable into meshing engagement with complementary teeth on said guide.

20. The improvement claimed in claim 18, wherein said lock member has an end movable into friction engagement with said guide.

21. The improvement claimed in claim 18, wherein said lock member comprises a fluid-operated piston.

22. The improvement claimed in claim 1, further comprising means for selectively pivoting said heel support member about a horizontal axis extending orthogonal to said direction.

* * * * *